US011852142B2

(12) United States Patent
Takamiya

(10) Patent No.: US 11,852,142 B2
(45) Date of Patent: Dec. 26, 2023

(54) GEAR PUMP WITH FLOATING BEARING WITH RECEIVER FACES

(71) Applicant: IHI Corporation, Tokyo (JP)

(72) Inventor: Kenji Takamiya, Tokyo (JP)

(73) Assignee: IHI Corporation, Tokyo (JP)

( * ) Notice: Subject to any disclaimer, the term of this patent is extended or adjusted under 35 U.S.C. 154(b) by 83 days.

(21) Appl. No.: 17/455,079

(22) Filed: Nov. 16, 2021

(65) Prior Publication Data

US 2022/0074408 A1 Mar. 10, 2022

Related U.S. Application Data

(63) Continuation of application No. PCT/JP2020/035162, filed on Sep. 17, 2020.

(30) Foreign Application Priority Data

Oct. 3, 2019 (JP) ..... 2019-182915

(51) Int. Cl.
*F04C 2/18* (2006.01)
*F04C 15/00* (2006.01)
*F04C 2/08* (2006.01)

(52) U.S. Cl.
CPC ..... *F04C 2/18* (2013.01); *F04C 2/088* (2013.01); *F04C 15/00* (2013.01);
(Continued)

(58) Field of Classification Search
CPC ..... F04C 2/082–088; F04C 2/18; F04C 2/20; F04C 18/082–088; F04C 18/18;
(Continued)

(56) References Cited

U.S. PATENT DOCUMENTS 3,372,646 A * 3/1968 Pinkas ..... F04C 13/005 418/102
2018/0106253 A1 4/2018 Takamiya et al.

FOREIGN PATENT DOCUMENTS

FR 3091317 A1 * 7/2020
GB 883356 A 11/1961
(Continued)

OTHER PUBLICATIONS

International Search Report dated Dec. 1, 2020 in PCT/JP2020/035162 filed on Sep. 17, 2020, 3 pages.
(Continued)

*Primary Examiner* — Laert Dounis
(74) *Attorney, Agent, or Firm* — Oblon, McClelland, Maier & Neustadt, L.L.P.

(57) ABSTRACT

A gear pump is provided with: a casing including a suction port configured to suck fluid, and a discharge port configured to expel the pressurized fluid; a gear including a wheel portion with gear teeth and an axially elongated shaft portion, the gear being so housed in the casing as to transport the fluid from the suction port to the discharge port; and a floating bearing rotatably supporting the shaft portion and being movable axially, the floating bearing including a sealing face in contact with the wheel portion, a receiver face axially opposed to the sealing face; and a communication path having an opening on the sealing face and communicating the opening with a third pressurization chamber defined by a third receiver face of the receiver face and the casing.

4 Claims, 4 Drawing Sheets

(52) U.S. Cl.
CPC ..... *F04C 15/0042* (2013.01); *F04C 2240/30* (2013.01); *F04C 2240/54* (2013.01); *F04C 2240/60* (2013.01)

(58) Field of Classification Search
CPC ..... F04C 18/20; F04C 15/0042–0049; F04C 29/0021–0035; F04C 2240/50–56
See application file for complete search history.

(56) References Cited

FOREIGN PATENT DOCUMENTS

| | | | |
|---|---|---|---|
| GB | 965470 | A | 7/1964 |
| GB | 1386237 | A | 3/1975 |
| JP | 43-010563 | B1 | 5/1968 |
| JP | 55-107092 | A | 8/1980 |
| JP | 57-038685 | A | 3/1982 |
| JP | 61-014489 | A | 1/1986 |
| JP | 04-101084 | A | 4/1992 |
| JP | 2005-344538 | A | 12/2005 |
| JP | 2015-194134 | A | 11/2015 |
| WO | WO 2017/009994 | A1 | 1/2017 |

OTHER PUBLICATIONS

Extended European Search Report issued in European Patent Application No. 20871137.4 dated Sep. 22, 2023.

* cited by examiner

GEAR PUMP WITH FLOATING BEARING WITH RECEIVER FACES

CROSS-REFERENCE TO RELATED APPLICATIONS

This application is a Continuation Application of PCT International Application No. PCT/JP2020/035162 (filed Sep. 17, 2020), which is in turn based upon and claims the benefit of priority from Japanese Patent Application No. 2019-182915 (filed Oct. 3, 2019), the entire contents of which are incorporated herein by reference.

BACKGROUND

Technical Field

The disclosure herein relates to a gear pump of a floating bearing type, which uses rotation of gears to pressurize and expel fluid, and in particular to a gear pump that keeps applying proper pressure onto the floating bearings even at higher rotational speed.

Description of the Related Art

A gear pump is usually provided with a pair of gears mutually in mesh and a housing that houses the gears and, by rotating the pair of gears in a flow path defined by the housing, pressurizes and expels fluid. Although a large flow rate is unhopeful, it is preferably applicable to some uses in which continuous fluid discharge is required. Examples of such uses are manufacturing equipment for extruding high viscosity polymers to produce resin products, hydraulic devices using pressurized working oil, and fuel feeder to reciprocating or jet engines.

Fixed bearings may be often used for supporting gears in the gear pump but, in considerable cases, floating bearings may be chosen. In a gear pump of a floating bearing type, a floating bearing is slightly movable axially and is pressed onto a gear wheel under a proper pressure to prevent fluid leakage through side faces thereof. Any spring of an elastic body may be used for pressurization onto the bearing and yet a pressure of the fluid pressurized by the gear pump by itself may be used.

Related arts are disclosed in Japanese Patent Application Laid-open No. 2005-344538 and International Publication No. WO 2017/009994

SUMMARY

The pressure generated by the gear pump in turn generates a reactive force on the gear wheel, which tends to pull the bearing away from the gear wheel. The pressurization on the bearing is required to be sufficient to counter this force and otherwise the bearing will float out of the gear wheel and then the fluid will begin to leak, thereby reducing the efficiency of the gear pump. In contrast if the pressurization is excessive, resistance to rotation of the gears will increase. This would also cause reduction of efficiency of the gear pump and as well heat generation by the resistance might give rise to unintentional failure.

If the generated pressure is used to apply pressurization onto the bearing, increase in pressure on one face of the bearing leads to increase in pressure on the other face. Thus any proper design made in light of dimensions of areas subject to the pressurization could balance them with each other. The present inventor, however, found out through his study that, when rotational speeds of the gears are increased in order to improve efficiency, the floating bearing could get unstable. The gear pump as disclosed hereafter has been created to overcome this problem.

A gear pump for pressurizing and expelling fluid according to the present disclosure is provided with: a casing including a suction port configured to suck the fluid, and a discharge port configured to expel the pressurized fluid; a gear including a wheel portion rimmed by gear teeth and a shaft portion axially elongated from the wheel portion, the gear being so housed in the casing that the gear teeth, by rotation of the gear about an axis, transport the fluid from the suction port to the discharge port; and a floating bearing rotatably supporting the shaft portion and being movable axially, the floating bearing including a sealing face in contact with the wheel portion, a receiver face axially opposed to the sealing face, the receiver face including a first receiver face in combination with the casing defining a first pressurization chamber in communication with the suction port, a second receiver face in combination with the casing defining a second pressurization chamber in communication with the discharge port, a third receiver face in combination with the casing defining a third pressurization chamber, and a communication path having an opening on the sealing face and communicating the opening with the third pressurization chamber.

Advantageous Effects

As pressure on the sealing face extracted through the communication path contains a pressure variate of an opposite phase relative to fluctuation of pressurization applied to the bearing and acts as negative feedback to the third receiver face, the pressurization on the bearing is kept within a proper range.

DESCRIPTION OF EMBODIMENTS

Exemplary embodiments will be described hereinafter with reference to the appended drawings.

A gear pump according to the present embodiment is used for fuel supply to an aeronautic engine for example and it pressurizes and expels relatively low viscosity fluid like oil such as kerosene. The following description relates to an example which employs a pair of gears mutually in mesh to rotate in inverse directions but it is merely for convenience of explanation. Three or more gears may be used or use of only one gear is possible. Further, one of the gears is connected via a shaft or gearing with an external power source and the other is a follower gear, although any particular references will not be found in the following description. Or, both the gears may be driving gears.

Figure 1:
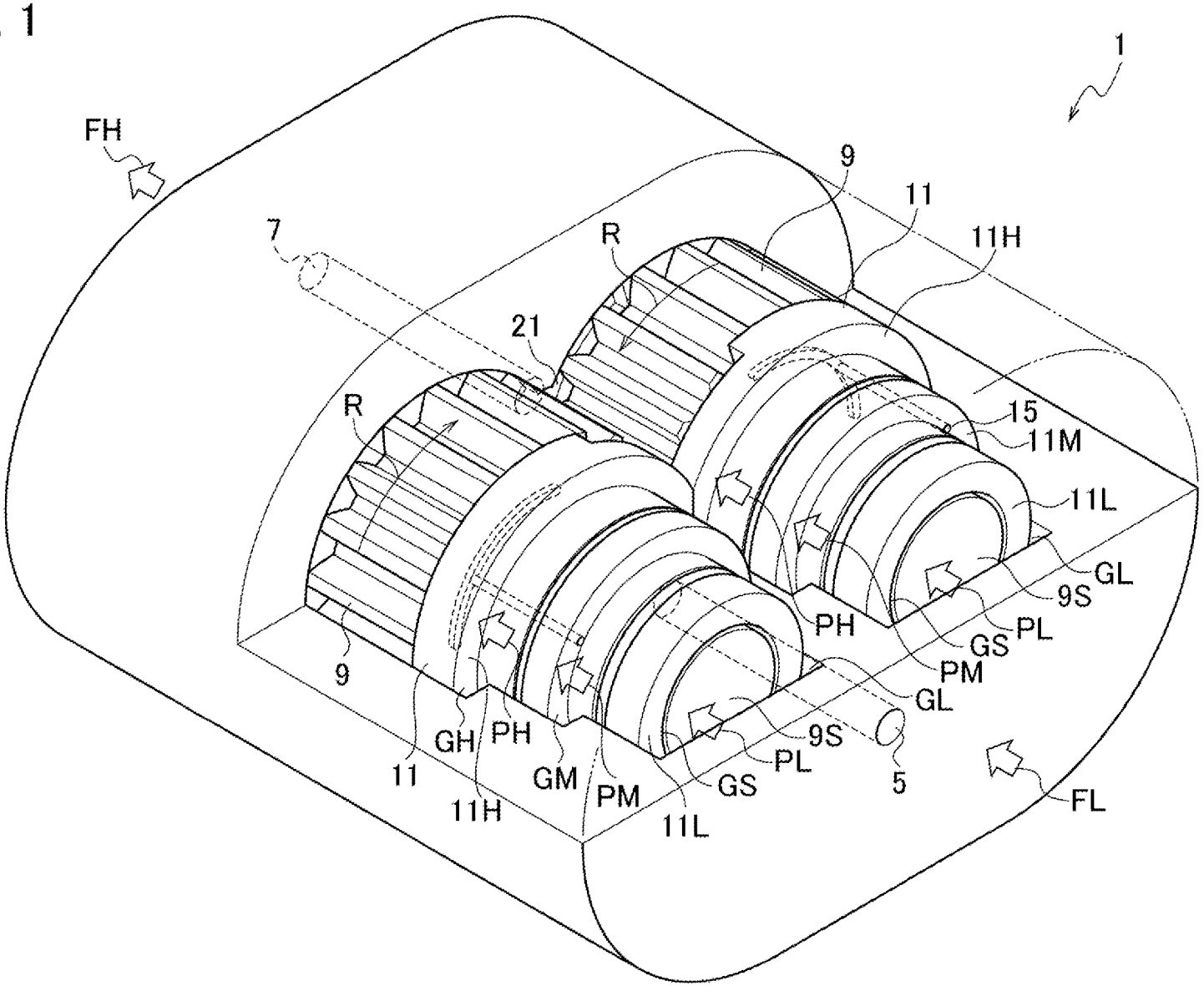
FIG. 1 is a perspective view of a gear pump in accordance with an embodiment, which partially shows its interior.
Figure 2:
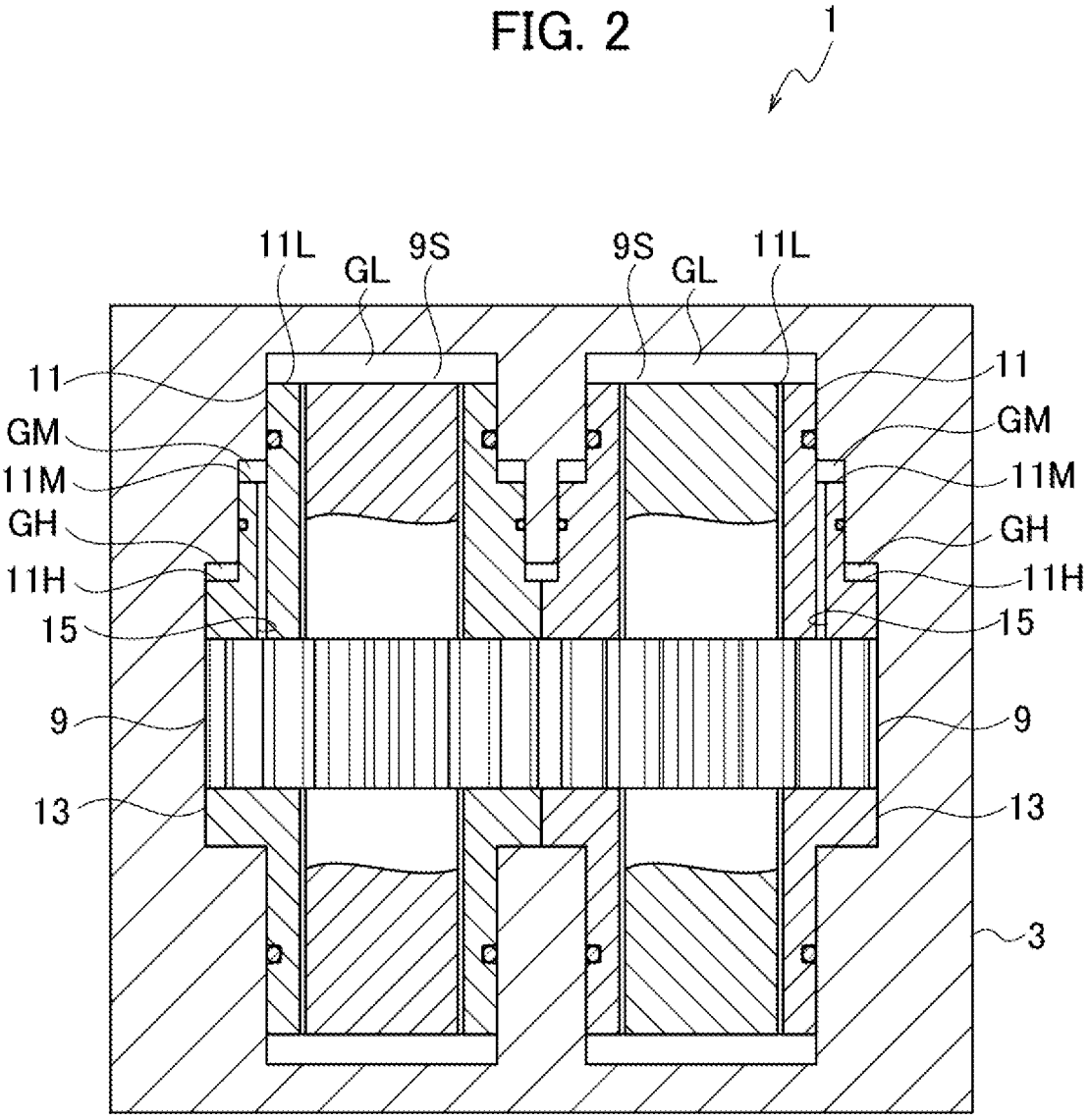
FIG. 2 is an elevational sectional view of the gear pump.

Referring mainly to FIGS. 1, 2, the gear pump 1 is generally constituted of a pair of gears mutually in mesh and a casing 3 housing them.

The casing 3 is provided with a suction port 5 and a discharge port 7. The former generally sucks fluid FL before pressurization and the latter expels pressurized fluid FH. In FIG. 1, the suction port 5 and the discharge port 7 are opened on both ends of the casing 3 but, as it is not limiting of course, they may be opened on upper and lower faces or side faces.

The casing 3 is configured to fluid-tightly seal its interior against the exterior, except communication between the interior and the exterior through the suction port 5 and the discharge port 7. The casing 3 is further so dimensioned as to contact with the peripheries of the wheel portions 9 and, as the gears make rotary motions R about respective axes, fluid enclosed in between gear teeth around the wheel portions 9 is transported with being pressurized. In a path in each revolution of the rotary motion R of the wheel portions 9, the suction port 5 is opened around the start point thereof and the discharge port 7 is opened around the end point thereof, thereby the fluid is sucked through the suction port 5 and pressurized and expelled through the discharged port 7.

Each gear is constituted of the wheel portion 9 rimmed by gear teeth and a shaft portion 9S axially elongated from the wheel portion 9. The shaft portion 9S serves for a pivot supported by a floating bearing 11 as described later, and the wheel portion 9 has a larger diameter than that and is generally cylindrical. The gear teeth is toothed on the periphery of the wheel portion 9 and may be formed as radial teeth toothed in parallel with the axis but instead may be slanted relative to the axis. Side faces of the wheel portion 9 may be flat so as to have face contact with sealing faces that will be described later. The shaft portion 9S may be formed in a unitary body with the wheel portion 9 but may be a separated body and combined therewith by means of press-fitting or such.

Each shaft portion 9S is rotatably supported by the bearings 11, 13 so that the gear is rotatable about its axis. The bearing 11 is, on one hand, a floating bearing movable axially and the bearing 13 may be, on the other hand, a fixed bearing fixed to, or at least immovable relative to, the casing 3. Or, the other bearing 13 may be a floating bearing also. Both the bearings 11, 13, or at least outer peripheries thereof, have substantially close contact with the casing 3. On the other hand, end faces thereof have some gaps toward the casing 3 and in particular the end face of the floating bearing 11 opposed to the faces facing to the wheel portion 9 holds pressurization chambers GL, GM and GH between itself and the casing 3, into which the fluid is introduced to pressurize the floating bearing 11. Details about them will be described later.

Figure 3:
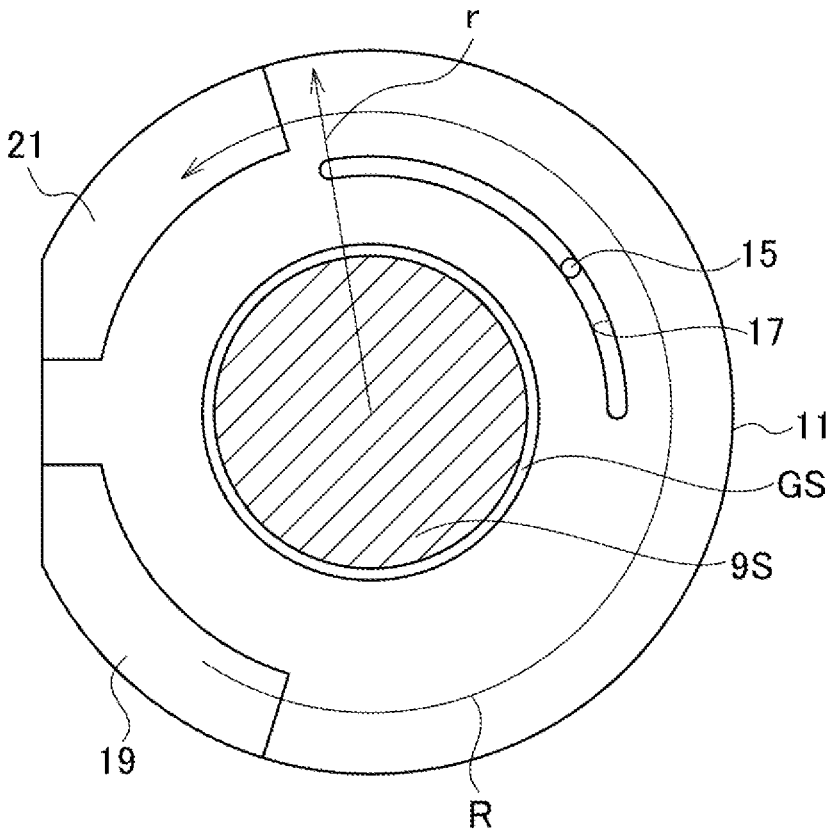
FIG. 3 is a plan view of a sealing face of a bearing viewed from the side of the gear wheel.

The bearings 11, 13 fit on the peripheries of the shaft portion 9S and rotatably support it, and at one ends thereof have contact with the side faces of the wheel portion 9. Referring to FIG. 3 in combination with FIGS. 1 and 2, between the internal peripheries of the bearings 11, 13 and the outer periphery of the shaft portion 9S, narrow gaps GS may be held and the fluid FL before pressurization flows into the gaps GS to effect lubrication. Each bearing 11, 13 as a whole is generally cylindrical but a portion thereof in contact with the adjacent bearing 11, 13 may be cut out to be flat.

The bearings 11, 13 at the ends in contact with the side faces of the wheel portion 9 have diameters sufficient to have face contact with substantially whole surfaces of the faces but, at portions fitting on the shaft portions 9S, may have smaller diameters. The ends having face contact with the side faces of the wheel portion 9 function as sealing faces for preventing fluid leakage through the side faces. These sealing faces are generally flat but have some recessed structures as described later.

Referring again to FIGS. 1, 2, in each floating bearing 11, the end axially opposed to the sealing face is constituted of pressure-receiver faces 11L, 11M, 11H respectively receiving pressurization by the fluid. Each floating bearing 11 may, although inessential, have a structure with stepwise diminution in diameter with distance from the wheel portion. The endmost or radially innermost shoulder may be the low-pressure receiver face 11L and the proximate or radially outermost shoulder may be the high-pressure receiver face 11H.

The low-pressure receiver face 11L in combination with the casing 3 defines a chamber GL. The chamber GL is directly or indirectly in communication with the suction port 5 and, as the fluid FL before pressurization is introduced therein, functions as a low-pressure pressurization chamber GL for pressurizing the low-pressure receiver face 11L. The low-pressure pressurization chamber GL may further be in communication with a gap GS inside the inner periphery of the bearing 11. The high-pressure receiver face 11H in combination with the casing 3, similarly, defines a chamber GH. The chamber GH is directly or indirectly in communication with the discharge port 7 and, as the pressurized fluid FH is introduced therein, functions as a high-pressure pressurization chamber GH for pressurizing the high-pressure receiver face 11H.

Each floating bearing 11 may be further provided with a shoulder radially outside the low-pressure receiver face 11L and radially inside the high-pressure receiver face 11H. This shoulder functions as a mid-pressure receiver face 11M, which in combination with the casing 3 defines a mid-pressure pressurization chamber GM. The floating bearing 11 may be further provided with a communication path 15 passing through the bearing of itself and opened on this shoulder and the sealing face. To the mid-pressure receiver face 11M, as described later, a pressure PM on the sealing face is applied through the communication path 15. Functions of the mid-pressure pressurization chamber GM or the mid-pressure receiver face 11M will be described later in more detail.

To separate the pressurization chambers GL, GM, GH from each other, O-rings or gaskets may be interposed around the floating bearing 11 for example. The stepwise structure described above is beneficial in interposing the O-rings or the gaskets between respective shoulders. Alternatively, by using any other proper structure or separation means, a part of or the totality of the receiver faces 11L, 11M, 11H may be on an identical plane.

Referring again to FIG. 3, the sealing face has an opening on the communication path 15, which is located radially inward from the gear teeth and radially outward from the shaft portion 9S. The sealing face may, although inessential, have a groove 17 continuous from the opening. The groove 17 can reserve a certain amount of fluid therein and is thus helpful to stabilize the pressure of the fluid fed to the communication path 15. Further the sealing face may, although inessential, have a recessed portion 19 in communication with the suction port 5 and a recessed portion 21 in communication with the discharge port 7, both of which function as fluid reservoirs.

Before starting the rotary motion R of the gears, as the fluid FL before pressurization intrudes in the low-pressure pressurization chamber GL to pressurize the low-pressure receiver face 11L, the floating bearing 11 is lightly pressed onto the wheel portion 9, thereby preventing the fluid from leaking through the side faces of the wheel portion 9. In place of, or in addition to, such pressurization, a spring of an elastic body may be used to apply pressurization.

Figure 4:
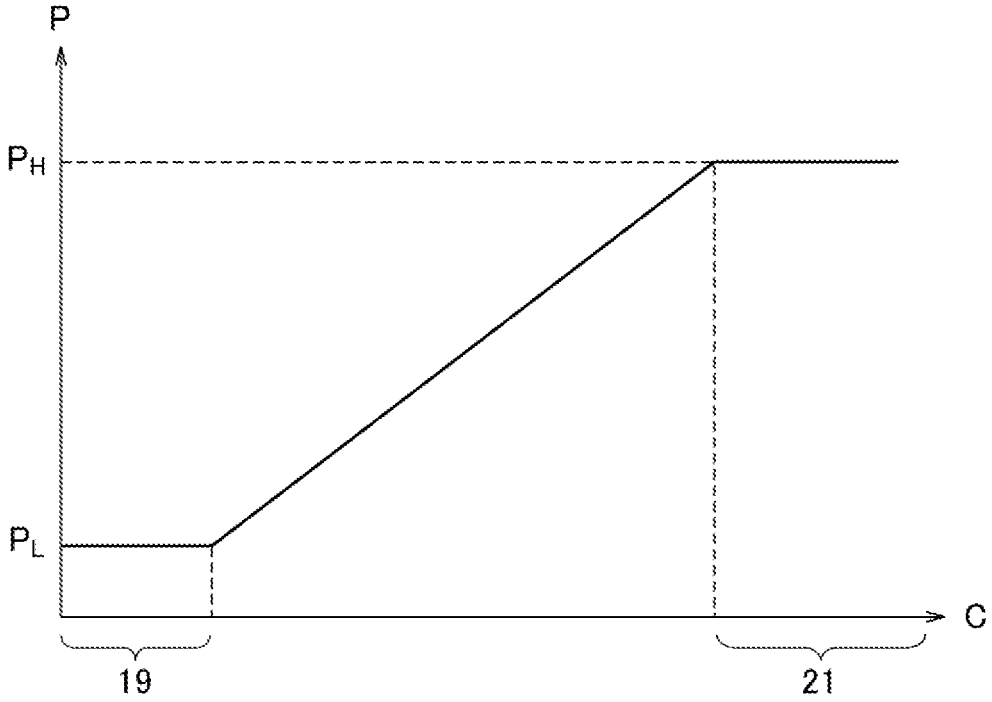
FIG. 4 is a graph schematically depicting a pressure profile of fluid on the sealing face, which is viewed along a direction where the gear wheel rotates.

Referring to FIG. 4 in combination with FIGS. 1-3, when the rotary motion R about the axis is given to each wheel portion 9, the fluid is transported in the circumferential direction C and simultaneously pressurized from a low pressure PL given to the fluid FL before pressurization up to a high pressure PH generated in the fluid FH after pressurization. FIG. 4 schematically illustrates this pressure gradient but it is not known whether the pressure gradient is so linear or not as in the drawing.

The pressurized fluid FH is introduced into the high-pressure pressurization chamber GH and its high pressure PH is there applied to the high-pressure receiver face 11H. As the pressurization is increased, the force that pulls the floating bearing 11 away from the wheel portion 9 is created, whereas opposed force acts on the high-pressure receiver face 11H. Consequently, in principle, both these forces compete with each other to prevent the fluid leakage through the side faces of the wheel portion 9.

Figure 5:
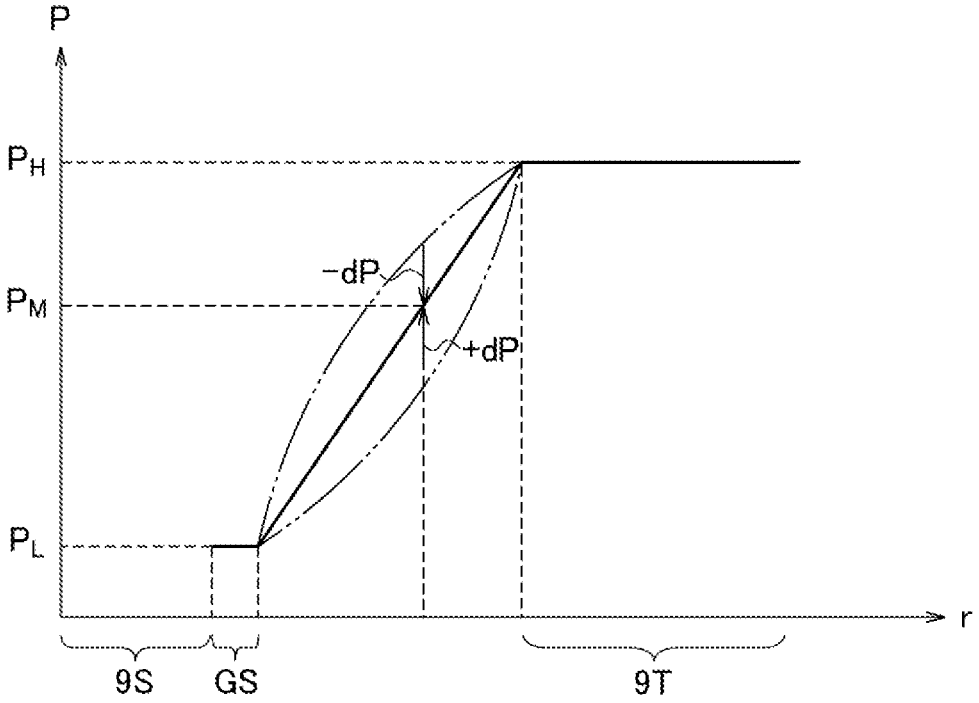
FIG. 5 is a graph schematically depicting a pressure profile of fluid on the sealing face, which is viewed along a diameter of the gear wheel.

On the other hand, as schematically shown in FIG. 5, another pressure gradient is created in the radial direction on the sealing face. More specifically, as the fluid FL intrudes into the gap GS around the shaft portion 9S, the pressure therein is identical to the low pressure PL, but the pressure rises along the radially outward direction and gets highest at a region 9T where the gear teeth sweep. As the opening of the communication path 15 is positioned radially inward from the wheel portion 9 and radially outward from the shaft portion 9S, the medium pressure PM is extracted, introduced to the pressurization chamber GM, and there applied to the mid-pressure receiver face 11M.

This pressure gradient is not settled but reflects the degree of contact between the sealing face and the side face of the wheel portion. More specifically, when the pressurization onto the floating bearing 11 is excessively small and then the contact between the sealing face and the side face of the wheel portion becomes insufficient, the pressure on the sealing face may be increased as intrusion of the pressurized fluid FH into the sealing face becomes prominent. On the other hand, when the pressurization gets excessive and then the contact becomes overly tight, the pressure on the sealing face may get lower. The medium pressure PM thus contains a pressure variate dP of an opposite phase relative to disturbances in the pressurization on the floating bearing 11. As this medium pressure PM is extracted and introduced to the mid-pressure pressurization chamber GM, the pressure variate dP of an opposite phase relative to the disturbance in the pressurization is applied to the mid-pressure receiver face 11M. This functions as a negative feedback circuit of a sort to keep the pressurization on the floating bearing 11 relative to the wheel portion within a proper range.

As will be understood from the above descriptions, the medium pressure PM and the pressure variate dP applied to the mid-pressure receiver face 11M depend on the position of the opening of the communication path 15 on the sealing face and also on the position of the groove 17. The positions in the radial direction and in the circumferential direction can be properly selected and then the device can be designed in accordance with the required properties. A range applicable thereto may extend from the shaft portion 9S to the gear teeth in the radial direction and from the recess portion 19 to the recess portion 21 in the circumferential direction, as described already.

Although certain embodiments have been described above, modifications and variations of the embodiments described above will occur to those skilled in the art, in light of the above teachings.

INDUSTRIAL APPLICABILITY

Provided is a gear pump which uses negative feedback to keep pressurization on bearings within a proper range, thereby retaining stability of the floating bearings even if the rotation speed is increased.

What is claimed is:

1. A gear pump for pressurizing and expelling fluid, comprising:

a casing including a suction port configured to suck the fluid, and a discharge port configured to expel the pressurized fluid;

a gear including a wheel portion rimmed by gear teeth and a shaft portion axially elongated from the wheel portion, the gear being so housed in the casing that the gear teeth, by rotation of the gear about an axis, transport the fluid from the suction port to the discharge port; and a floating bearing rotatably supporting the shaft portion and being movable axially, the floating bearing including a sealing face in contact with the wheel portion, and a receiver face axially opposed to the sealing face, the receiver face including a first receiver face in combination with the casing defining a first pressurization chamber in communication with the suction port, a second receiver face in combination with the casing defining a second pressurization chamber in communication with the discharge port, a third receiver face in combination with the casing defining a third pressurization chamber, and a communication path having an opening on the sealing face and communicating the opening with the third pressurization chamber, wherein the third receiver face is disposed radially outward from the first receiver face and radially inward from the second receiver face.

2. The gear pump of claim 1, wherein the opening of the communication path is disposed radially inward from the gear teeth and radially outward from the shaft portion on the sealing face.

3. The gear pump of claim 1, further comprising:

a groove so elongated in a circumferential direction on the sealing face as to keep the fluid between the wheel portion and the sealing face, the groove being in communication with the opening of the communication path.

4. The gear pump of claim 3, wherein the sealing face has a low-pressure recessed portion in communication with the suction port and a high-pressure recessed portion in communication with the discharge port, and the groove is so disposed as not to overlap with the low-pressure recessed portion and the high-pressure recessed portion in the circumferential direction.

* * * * *